United States Patent [19]

Guenther

[11] 4,021,265

[45] May 3, 1977

[54] METHOD AND APPARATUS FOR CLEANING TUBULAR STRUCTURES

[75] Inventor: Robert Patrick Guenther, Middletown Township, Monmouth County, N.J.

[73] Assignee: Bell Telephone Laboratories, Incorporated, Murray Hill, N.J.

[22] Filed: Dec. 4, 1975

[21] Appl. No.: 637,742

[52] U.S. Cl. ..... 134/22 C; 15/104.18; 138/93

[51] Int. Cl.[2] ..... B08B 9/02

[58] Field of Search ..... 15/104.16, 104.18; 134/22 C; 138/93, 97

[56] References Cited

UNITED STATES PATENTS

| | | | |
|---|---|---|---|
| 300,636 | 6/1884 | Pike | 134/22 C |
| 1,513,228 | 10/1924 | Crotto | 15/104.16 X |
| 2,932,837 | 4/1960 | Ver Nooy | 138/97 |
| 3,232,207 | 2/1966 | Gibbons | 138/93 X |
| 3,618,639 | 11/1971 | Daley et al. | 138/93 X |
| 3,834,422 | 9/1974 | Larson | 138/93 X |

*Primary Examiner*—Christopher K. Moore
*Attorney, Agent, or Firm*—Barry H. Freedman; Thomas Stafford

[57] ABSTRACT

Removal of foreign objects from tubular structures is accomplished by inserting a pressurizable tube with an expandable end chamber into the tubular structure past the position of the foreign object, forming a seal within the interior of the structure by expanding the end chamber, and withdrawing the tube to remove the obstruction. If desired, cleansing of the inner surface of the structure can be achieved by feeding a cleaning substance into the tube as it is being withdrawn.

22 Claims, 6 Drawing Figures

METHOD AND APPARATUS FOR CLEANING TUBULAR STRUCTURES

BACKGROUND OF THE INVENTION

1. Field of the Invention

This invention relates generally to the removal of foreign objects or contaminents from tubular structures and more particularly to an apparatus and method ideally suited by simultaneously cleansing and removing water from the interior of a waveguide.

2. Description of the Prior Art

Tubular structures, such as waveguides, conduits or pipelines, when damaged, can collect or become clogged with foreign objects, which often impede the normal function of the structure even if the damage is repaired. These contaminents or obstructions must be removed before normal operation of the structure can be resumed. In some instances, mechanical scraping devices have been employed to clear out blockages. A metal wire connected to the scraping device is often used as a means of remotely controlling the insertion of the scraping apparatus. However, the lack of stiffness of the wire limits the distance that the operator can push the scraping mechanism into the tubular structure. In addition, scraping devices are often unsatisfactory where the structures to be cleaned are delicate or susceptible to internal damage. In the case of the waveguide, water which enters upon accidental rupture may be the "foreign object"; such water causes contamination to the waveguide and severely attenuates energy modes traveling throughout the structure. While collected water cannot be removed by scraping devices, another prior art technique, known as "pigging", can be used. Specifically, the "pig" is inserted into the waveguide and blown through by an external force, usually compressed air. However, since no mechanical link is maintained between the device and the operator, the position of the pig within the structure is difficult to control remotely. The pig must travel the entire length of the waveguide before removal, causing additional contamination to occur. Also, because the pig must be inserted at one place and retrieved at another often miles apart, time loss, resulting in additional unnecessary damage to the structure, cannot be avoided.

Another prior art cleaning arrangement consists of a plurality of scraper and brush type elements mounted upon a central body which propagates through the tubular structure in manner corresponding to the above-described pig. A self-contained gas charge, or similar means, is employed to govern the pressure exerted upon the walls of the conduit by the cleaning elements. While this arrangement may be advantageous in some instances, numerous problems nevertheless remain. Primarily, complexity in the design of such devices results in high manufacturing cost as well as a greater chance of malfunction. Secondly, as with the pigging technique, the position of the device within the tubular structure is difficult to control remotely as no mechanical link exists between the apparatus and the operator. Thirdly, these devices are not able to introduce cleaning fluids from an external source into the apparatus, to be used to wash the walls of tubular structure as the obstruction is being removed.

In view of the foregoing discussion, it is a broad object of the present invention to provide an improved method and apparatus for cleaning tubular structures, where cleaning includes the removal of foreign ofjects or fluids lodged or collected within the structure. Specific objects include increasing insertion distance of the device into the tubular structure, conveniently and reliably controlling the position of the device in the tubular structure, and simplifying the overall design and construction of the device while yet permitting the introduction of a cleaning substance into the device.

SUMMARY OF THE INVENTION

Each of the foregoing and additional objects are achieved in accordance with the principles of the present invention by a cleaning apparatus which includes a pressurizable tube with an expandable end chamber, a self-contained fluid source for expanding the end chamber, such as a $CO_2$ charged cylinder, a piston or similar pressure responsive means for controlling fluid discharge from the source, and apertures in the housing of the device through which cleaning fluid can be expelled to wash the interior surface of the tubular structure. In operation, the tube is initially pressurized by an external source, and the apparatus is propelled or inserted into the structure to be cleaned, past the position of the foreign object. External tube pressure is then reduced or removed, operating the pressure responsive means. This, in turn, releases the self-contained fluid and inflates the expandable end chamber into tight fitting relationship with the interior surfaces. Finally, the apparatus is withdrawn, removing the obstruction by virtue of the wiping action which occurs between the expanded end chamber and the interior of the structure. In addition, if desired, cleansing of the inner surface of the structure can be achieved by feeding a cleaning substance into the tube as the apparatus is being withdrawn.

By virtue of the aforedescribed design, the stiffness of the pressurized tube upon insertion increases the distance that the operator can push or propel the device into the tubular structure. In addition, remote control of the device is easily accomplished, since the operator simply removes or releases tube pressure to cause the expandable end chamber to inflate. Still further, the use of an expandable end chamber which acts as a wiper to remove foreign objects as the device is being withdrawn from the tubular structure is advantageous, in that no scraping is involved which could damage the interior of the structure. Also, the introduction of a cleaning substance into the tube from some external source, as the device is being withdrawn, is permitted by the advantageous design.

BRIEF DESCRIPTION OF THE DRAWING

Further advantages and features of the present invention will be more readily understood from the following detailed description, when read in light of the accompanying drawing, in which.

DETAILED DESCRIPTION

Figure 1:
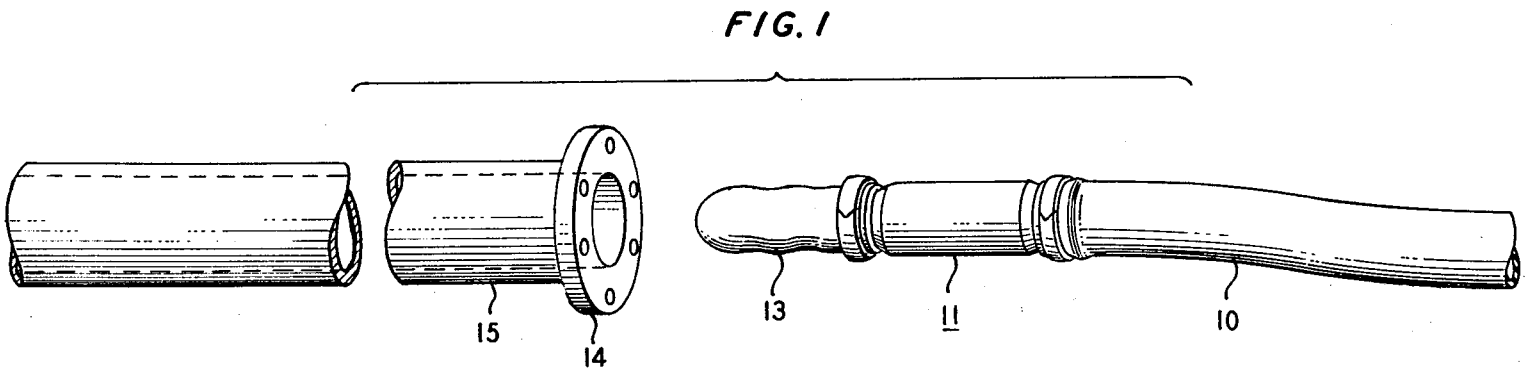
FIG. 1 is an overall view in perspective of an apparatus for removing foreign objects from a tubular structure in accordance with the invention in its deflated or unexpanded condition, prior to insertion into the tubular structure.
Figure 2:
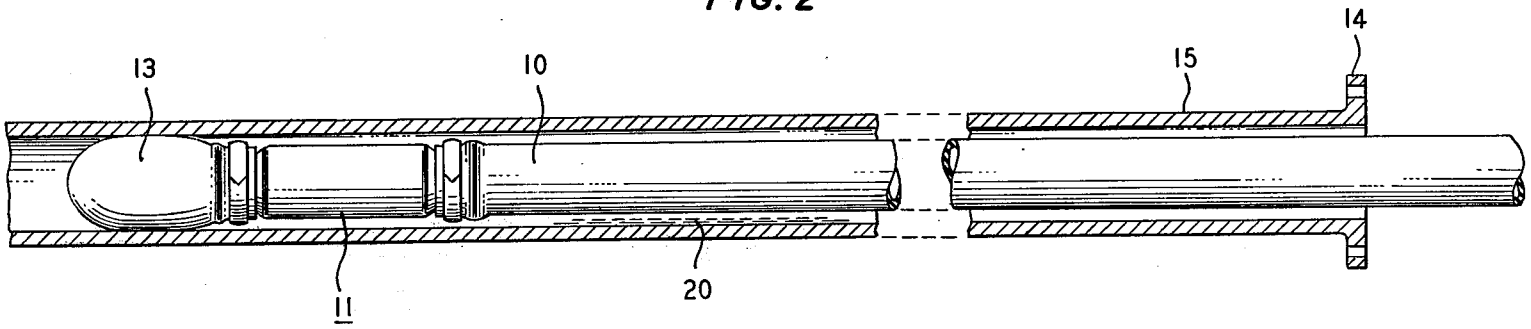
FIG. 2 is an overall view similar to FIG. 1, in which the apparatus has been expanded within the tubular structure.
Figure 3:
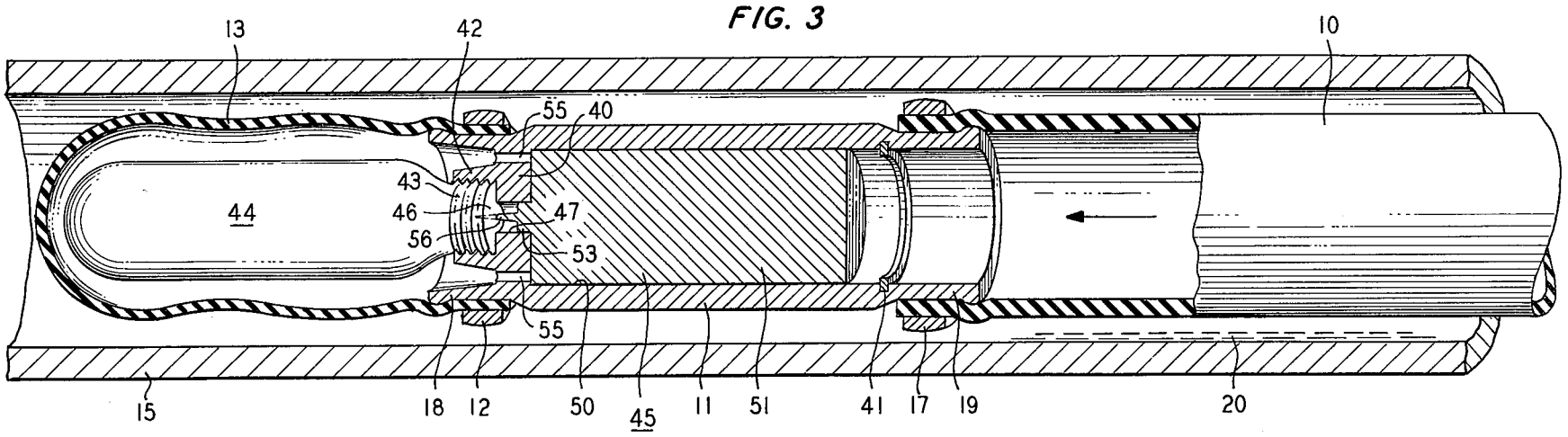
FIG. 3 is a cut-away view, in perspective, showing the internal structure of one embodiment of the invention as it appears when the apparatus is being inserted into a duct.
Figure 4:
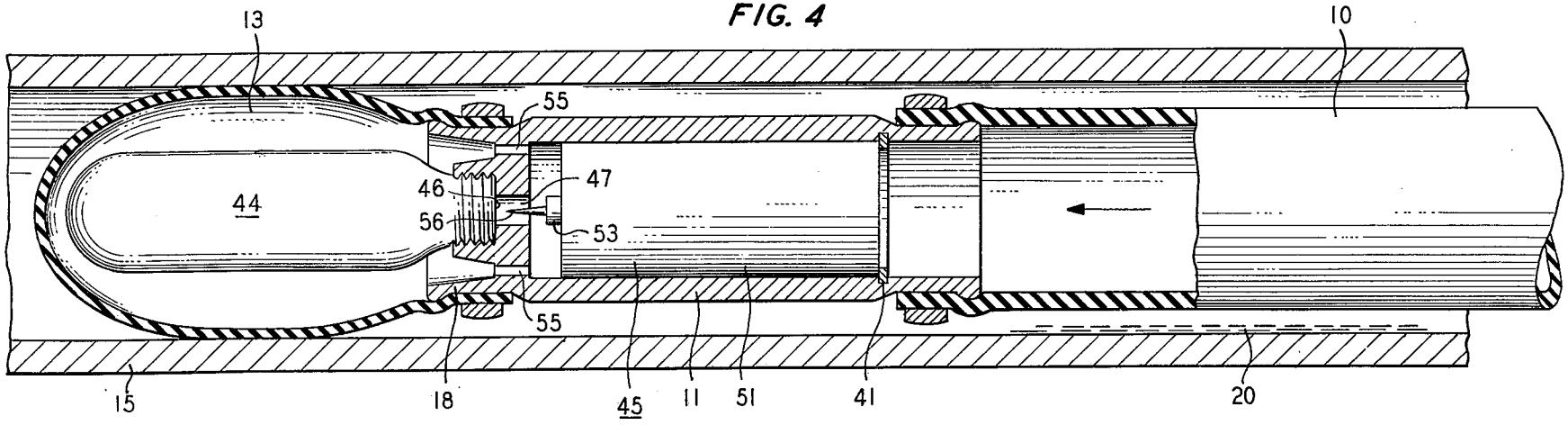
FIG. 4 is a sectional view showing the internal structure of the embodiment of FIG. 3 as it appears when the apparatus is being withdrawn from a duct.

Details of the invention will best be understood by first considering one embodiment thereof, depicted in various views and conditions in FIGS. 1–4, in which the same numerals are used to indicate similar parts. As will be discussed more fully below, FIGS. 1 and 2 show the object removal apparatus in the different stages of operation; FIGS. 3 and 4 illustrate the internal members of the device in detail.

The apparatus of the present invention is intended to remove foreign objects and contaminants, such as water 20, which may collect in an elongated or tubular structure such as waveguide 15 on accidental rupture. The cleaning apparatus is designed to be inserted into the waveguide 15 at the damage site while repair of the damaged portion is being made, for example, at flange 14. The apparatus comprises, generally, a hollow pressurizable tube 10, an expandable end chamber 13, and a centrally disposed housing member 11 between tube 10 and chamber 13.

More specifically, the housing member 11 is a generally cylindrical, rigidly constructed member serving primarily as a housing for the other internal components used in the water removal process. A tapered neck 18 at one (distal) end of the housing member 11 permits connection of the expandable end chamber 13 thereto, for example, by clamp 12. A similar tapered neck section 19 at the other (proximal) end of the housing 11 permits connection of a hollow flexible tube 10, for example, by clamp 17. Expandable end chamber 13 may be a balloon-like chamber constructed of a variety of flexible materials, such as rubber. When deflated, chamber 13 assumes a cylindrical shape with dimensions comparable to those of the housing 11, so that the apparatus is easily inserted into the structure to be cleaned. Once inflated, however, the chamber 13 must expand into close fitting relationship with the interior of the waveguide 15. In this expanded condition, the chamber acts as a wiper to clean the interior surfaces of the structure when the apparatus is withdrawn.

Referring to FIGS. 3 and 4, a cut-away view of the central housing member 11 is shown. The housing, which is preferably cylindrically shaped and rigidly constructed, defines a smooth walled internal chamber or cavity 50 having a distal end near tapered neck 18 and a proximal end communicating with tube 10. An end plate 40 is formed in the distal end and a stopper ring 41 is formed in a recessed groove near the proximal end. Cavity 50 contains a piston assembly designated generally at 45, which is free to move or slide longitudinally therein. An integral threaded flange 42 is formed on the distal side of end plate 40 and is arranged to allow connection between the plate and the neck 43 of a self-contained fluid source, such as pressurized $CO_2$ container 44. Container 44 is advantageously dimensioned so as to easily fit within expandable end chamber 13, and includes a frangible or pierceable diaphragm 46 formed in the neck 43. End plate 40 further includes a first passageway or aperture 47 which permits communication between cavity 50 and diaphragm 46, and at least one other passageway or aperture 55 which permits communication between cavity 50 and expandable end chamber 13.

Piston assembly 45, in its simplest form shown in FIGS. 3 and 4, includes a piston 51 which forms a tight seal with the walls of cavity 50. Assembly 45 serves two basic functions: first, an integral plug 53 formed on the piston distal end surface and aligned with aperture 47 permits sealing of that aperture when the piston is moved toward end plate 40. Second, a piercing member 56 having a pointed tip extending from plug 53 is provided to protrude through aperture 47 and pierce diaphragm 46.

With general reference to FIGS. 1 through 4, the operation of the apparatus of the present invention may be explained as follows: first, fluid pressure (air, for example) from an external source, not shown, is initially applied to the proximal end tube 10, forcing the piston assembly 45 toward the end plate 40. The piercing member 56 moves through aperture 47 and pierces diaphragm 46. However, since the plug 53 is then fully positioned within aperture 47, fluid cannot escape from pressurized source 44 or enter chamber 13. The sealing action is enhanced by the mechanical advantage gained by virtue of the large proximal end surface of piston 51 compared to the small end surface of plug 53.

While in the above condition (FIGS. 1 and 3), the apparatus is inserted into the waveguide 15 and positioned beyond the location of the water 20 to be removed. Insertion ease is enhanced, since by pressurizing the flexible tube 10, its stiffness is increased. Once the apparatus is properly positioned, external pressure in tube 10 is next removed or reduced, whereupon piston assembly 45 is forced away from end plate 40 by the fluid pressure released from source 44 (see FIG. 4). The escaping source fluid passes through the diaphragm 46, apertures 47 and 55 in the end plate 40, and into the end chamber 13, which expands into tight fitting relation with the interior walls of waveguide 15. Water removal is then accomplished by slowly withdrawing the apparatus from the waveguide (FIG. 2), with the expanded end chamber acting as a wiper.

Figure 5:
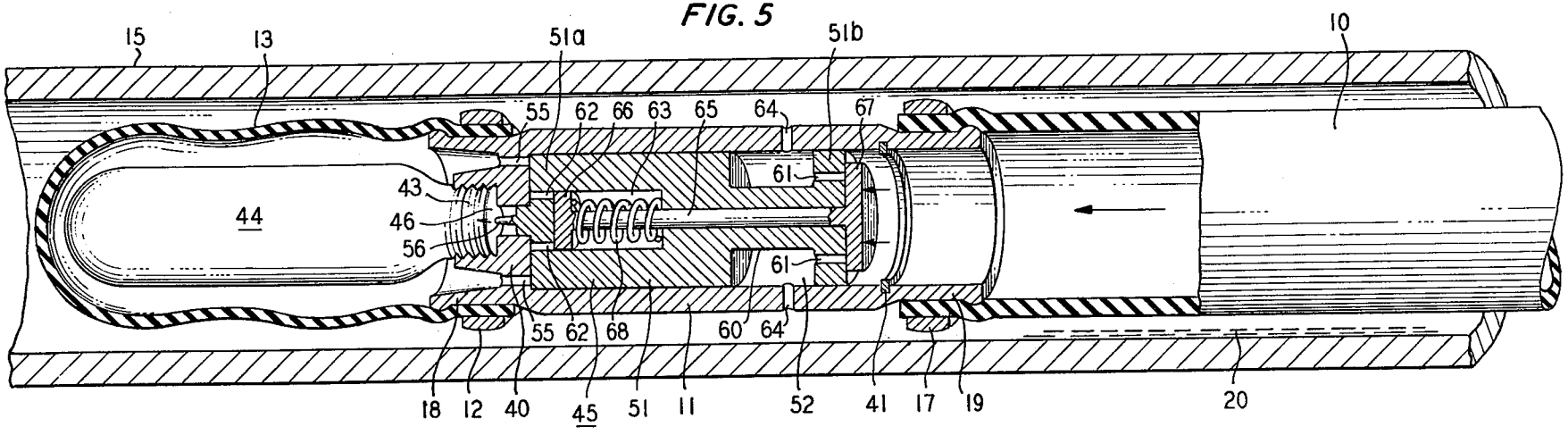
FIG. 5 is a cut-away view, in perspective, of the internal structure of another embodiment of the invention, during insertion.
Figure 6:
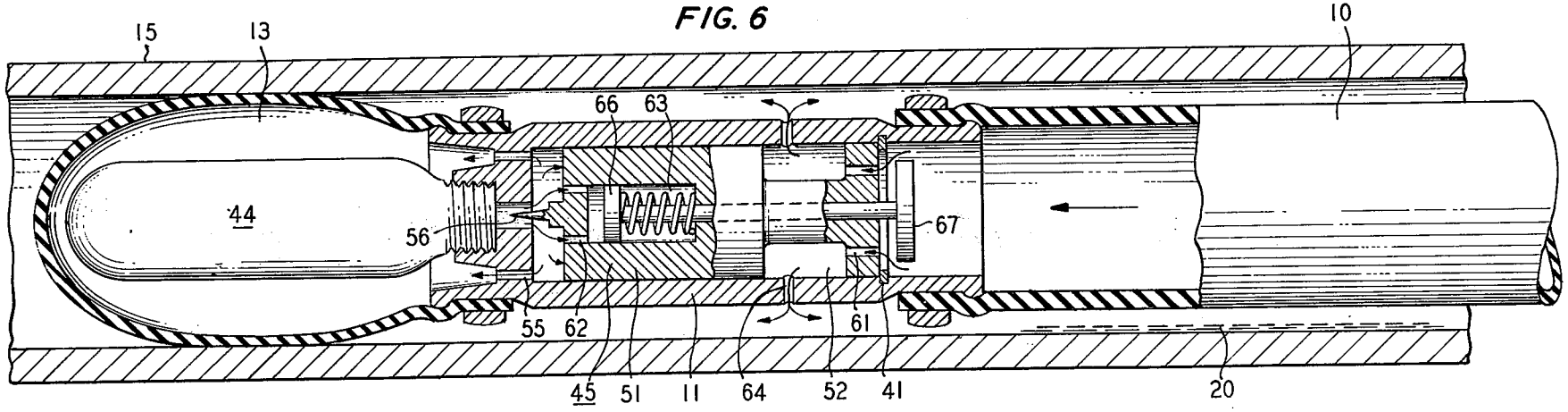
FIG. 6 is a sectional view similar to FIG. 5 but during withdrawal.

If cleaning of the interior walls of the waveguide with a cleaning substance is desired in addition to water or object removal, another embodiment of the invention can be used, as shown in FIGS. 5 and 6. As illustrated in cut-away view, a narrowed section 60 is formed on piston 51, which is centrally located between the wider distal and proximal end sections **51*a* and 51*b*, respectively. Narrowed section 60 forms a small subchamber 52 within cavity 50. One or more passageways or apertures 61 are formed in proximal end section 51*b* and a second set of passageways or apertures 64 are formed in the walls of housing 11 adjacent to subchamber 52. In this way, a cleaning substance introduced into tube 10 can enter the subchamber 52 and exit via apertures 64 to the interior of waveguide 15 in the vicinity to be cleaned. To control the passage of the cleaning substance through the above-described path between tube 10 and structure 15, apertures 62 are also formed in the end surface 53, so as to allow communication between the internal cavity 50 and a hollow chamber 63 coaxially formed within distal end 51*a* of a piston 52. A coaxial bore is also formed within the remaining portion of piston 51 for slideably receiving a connecting rod 65 therein. Affixed to rod 65** at its distal end is a head 66 disposed within chamber 63; a second head 67 affixed to the proximal end of rod 65. Head 67 has a diameter which is large enough to cover or block apertures 61, but is smaller than the inner diameter of housing 11. A coil spring 68 surrounds the portion of rod 65 within chamber 63, and serves to maintain head 67 flush with the outer proximal surface of piston 51, thereby sealing apertures 61.

In its initial stages, operation of the embodiment of FIGS 5 and 6 is similar to that described above with respect to FIGS. 1–4. Specifically, pressure from an external source (not shown) is applied to tube 10, whereupon piston assembly 45 is caused to move toward end plate 40, and diaphragm 46 is pierced by member 56 (see FIG. 5). At this time external fluid escape through apertures 64 is prevented because head 67 seals apertures 61 by action of spring 68. After the apparatus has been positioned at the desired location, external pressure in tube 10 is removed, whereupon stored fluid from source 44 inflates end chamber 13 and also moves assembly 45 back to the right.

Operation differs from that description hereinabove in that fluid from source 44 present in cavity 50 also enters chamber 63 via apertures 62. Pressure is thus applied to head 66, compressing spring 68 and moving the assembly comprising head 66, 67 and rod 65 still further to the right. In this condition, as shown in FIG. 6, head 67 is maintained in spaced relation from and no longer blocks apertures 61. Accordingly, a cleaning substance, for example, water or nitrogen gas, introduced into tube 10 will pass in turn through apertures 61 and 64 and thereby become available for cleaning the interior of waveguide 15 as the apparatus is withdrawn.

Based upon the foregoing, it will be seen that apparatus constructed in accordance with the invention permits quick and efficient water removal and general cleaning of the interior surfaces of cylindrical ducts and pipes and does not require skilled technicians in its operation. To remove collected water, the operator need only apply external pressure to the tube, insert the apparatus past the damage area, release the external pressure and slowly withdraw the apparatus. If the embodiment of FIGS. 5 and 6 is used, further cleaning is accomplished by introducing a cleaning substance into the tube during withdrawal. The apparatus acts automatically in that when external pressure is released, the expandable chamber is inflated and a path for release of the cleaning substance is created.

Various modifications of the apparatus described above will be apparent to those skilled in the art. For this reason, it is intended that the invention be limited only by the following claims.

What is claimed is:

1. Apparatus for cleaning the interior surfaces of a tubular structure, comprising:
- first means adapted to expand into close fitting relationship with said interior surfaces of said tubular structure and to act as a wiper when so expanded;
- a hollow pressurizable tube connected to said first means for positioning said first means at a desired location within said structure;
- a source of fluid; and
- second means operative in response to a predetermined sequence of changes in pressure of a fluid within said hollow tube for releasing fluid from said source into said first means to expand said first means.

2. Apparatus for removing a contaminant from the interior of a tubular structure, comprising:
- a hollow tube;
- a chamber adapted to expand into tight fitting relationship with said interior of said tubular structure upon the application of pressurized fluid thereto;
- a source of pressurized fluid positioned within said chamber;
- a housing defining an internal cavity and having a distal end connected to said expandable chamber and a proximal end connected to said hollow tube; and
- means within said housing adapted to release fluid from said source into said expandable chamber in response to a predetermined sequence of changes in pressure of a fluid in said hollow tube.

3. Apparatus for cleaning the interior surfaces of an elongated structure from a remote location, including:
- an expandable cleaning element adapted for easy insertion in said structure when unexpanded and for cleaning of said surfaces when withdrawn in an expanded state;
- a pressurizable tube having a hollow interior for positioning said cleaning element at a desired location within said structure;
- means connecting said pressurizable tube and said cleaning element and being operative for expanding said cleaning element; and
- means responsive to a predetermined sequence of changes in pressure of a fluid applied to said interior of said tube at said remote location for operating said expanding means.

4. The invention defined in claim 3 wherein said cleaning element includes a flexible, balloon-like chamber.

5. Apparatus for removing a liquid from the interior of a tubular structure, comprising:
- an expandable wiper element adapted for insertion into said structure,
- a pressurized tube connected to said element for positioning said element at a desired location within said structure; and
- means communicating with said element and said tube for expanding said element when said tube is depressurized, whereby said liquid may be removed from said structure by withdrawal of said apparatus therefrom.

6. The apparatus defined in claim 5, wherein said expanding means includes
- a source of fluid;
- a housing defining a path of fluid flow from said source to said element; and
- a piston in said housing for maintaining said path closed when said tube is pressurized.

7. A method of cleaning the interior surfaces of a tubular structure, comprising the steps of:
- pressurizing a hollow tube having connected at its distal end a housing and a chamber adapted to expand upon reduction of said pressure;
- inserting said tube into said structure so as to position said chamber past the surface to be cleaned;
- reducing said pressure in said hollow tube whereby said chamber is expanded; and
- withdrawing said tube from said structure whereby said interior surfaces are cleaned by wiping action of said chamber.

8. The invention defined in claim 7 wherein said reducing step includes the step of releasing into said chamber a fluid stored in a pressurized container positioned within said chamber.

9. The invention defined in claim 7 further including the steps of introducing a cleaning substance into said tube during withdrawal and creating a path for escape of said substance from said housing in response to said release of said fluid.

10. Apparatus for cleaning the interior surfaces of a tubular structure, comprising:

first means adapted to expand into close fitting relationship with said interior surfaces of said tubular structure and to act as a wiper when so expanded;

a hollow tube connected to said first means for positioning said first means at a desired location within said tubular structure;

a source of fluid including a container of pressurized fluid sealed with a pierceable diaphragm positioned within said first means; and second means operative in response to a predetermined sequence of changes in pressure of a fluid within said tube for releasing fluid from said source into said first means.

11. The invention defined in claim 10 wherein said apparatus further includes a housing defining an internal cavity having a proximal end communicating with said tube and a distal end communicating with said first means via a first passageway and communicating with said diaphragm via a second passageway; and said second means includes a piston assembly slideably positioned within said cavity and adapted to pierce said diaphragm and seal said passageways upon a first one of said predetermined sequence of pressure changes and to permit escape of fluid from said source through said diaphragm and passageways to said first means upon a subsequent second one of said predetermined sequence of pressure changes in said tube.

12. The invention defined in claim 11 wherein said apparatus further includes a third passageway formed in said housing and permitting communication between said tube and said interior surfaces of said structure; and third means responsive to escape of fluid from said source for permitting flow through said third passageway of a cleaning substance introduced in said tube.

13. Apparatus for removing a contaminant from the interior of a tubular structure, comprising:

a hollow tube;

a chamber adapted to expand into tight fitting relationship with said interior of said tubular structure upon the application of fluid thereto;

a source of fluid including a container having a frangible seal;

a housing defining an internal cavity and having a distal end connected to said expandable chamber and a proximal end connected to said hollow tube; and means within said housing including a piston assembly adapted to break said seal for releasing fluid from said source into said expandable chamber in response to a predetermined sequence of changes in pressure of a fluid in said hollow tube.

14. The invention defined in claim 13 wherein said housing includes an end plate formed in said distal end of said cavity;

said plate includes (a) a first aperture, (b) means for positioning said container within said expandable chamber so that said diaphragm is adjacent to said first aperture, and (c) a second aperture permitting communication between said cavity and said chamber; and said piston assembly includes (a) a pointed tip adapted to extend through said first aperture and pierce said diaphragm upon the initial application of pressure to said tube, and (b) means adapted to prevent passage of fluid from said source through said apertures to said chamber until said tube pressure is subsequently reduced.

15. The invention defined in claim 14 wherein said apparatus further includes means responsive to the pressure within said cavity of fluid from said source for establishing a path of communication between said tube and said interior of said tubular structure.

16. The invention defined in claim 15 wherein said piston assembly further includes a narrowed central section between wider distal and proximal end sections, said narrowed section defining a subchamber within said cavity, and wherein said apparatus further includes:

a third aperture formed in said housing adjacent said subchamber;

a fourth aperture formed in said proximal end section adapted to permit communication between said tube and said subchamber;

an internal chamber formed coaxially within said distal end section for receiving fluid from said source; and means partially disposed within said internal chamber for controlling the opening of said fourth aperture in response to receipt of said fluid.

17. The invention defined in claim 16 wherein said controlling means includes:

means for maintaining said fourth aperture closed when fluid from said source is absent from said internal chamber and for maintaining said fourth aperture open when fluid from said source is present in said internal chamber.

18. Apparatus for cleaning the interior surfaces of an elongated tubular structure from a remote location, comprising:

an expandable cleaning element including a flexible, balloon-like chamber and being adapted for easy insertion in said tubular structure when unexpanded and for cleaning of said surfaces when withdrawn in an expanded state;

a tube having a hollow interior for positioning said cleaning element at a desired location within said tubular structure;

means connecting said element and said tube and being operative for expanding said cleaning element including a container of pressurized fluid positioned within said cleaning element; and means responsive to a predetermined sequence of changes in pressure of a fluid applied to said interior of said tube at said remote location for operating said expanding means.

19. The invention defined om claim 18 wherein said operative means is arranged to permit entry of fluid from said container into said cleaning element when pressure is applied to said tube and subsquently released.

20. The invention defined in claim 19 wherein said container includes a neck sealed by a pierceable diaphragm; and said operating means includes a. a housing defining an internal cavity having a distal end connected to said cleaning element and a proximal end communicating with said interior of said tube, b. an end plate formed in said distal end, c. a first aperture formed in said end plate, d. means for connecting said neck to said end plate to align said diaphragm with said first aperture, e. a second aperture formed in said end plate adapted to permit communication between said cavity and said cleaning element, and f. a piston assembly within said cavity arranged to pierce said diaphragm and seal said apertures upon application of pressure to said tube.

21. The invention defined in claim 20 wherein said piston assembly includes a plug aligned with said first aperture for sealing said first aperture when inserted therein, and a pointed tip formed on said plug for piercing said diaphragm through said first aperture.

22. The invention defined in claim 20 wherein said apparatus further includes means reponsive to the presence of said pressurized fluid in said cavity for establishing a path of communication between said interior of said hollow tube and said interior surfaces of said structure.

* * * * *